US011313640B2

(12) United States Patent
Langley

(10) Patent No.: US 11,313,640 B2
(45) Date of Patent: Apr. 26, 2022

(54) CROSSBOW ASSEMBLY

(71) Applicant: Bear Archery, Inc., Evansville, IN (US)

(72) Inventor: Timmy Langley, McDaniels, KY (US)

(73) Assignee: Bear Archery, Inc., Evansville, IN (US)

( * ) Notice: Subject to any disclaimer, the term of this patent is extended or adjusted under 35 U.S.C. 154(b) by 0 days.

(21) Appl. No.: 17/249,150

(22) Filed: Feb. 22, 2021

(65) Prior Publication Data

US 2021/0180908 A1 Jun. 17, 2021

Related U.S. Application Data

(63) Continuation of application No. 15/929,346, filed on Apr. 28, 2020, now Pat. No. 10,962,323.

(60) Provisional application No. 62/844,182, filed on May 7, 2019.

(51) Int. Cl.
*F41B 5/12* (2006.01)
*F41B 5/14* (2006.01)
*F41B 5/00* (2006.01)

(52) U.S. Cl.
CPC ..... *F41B 5/123* (2013.01); *F41B 5/1411* (2013.01); *F41B 5/0094* (2013.01)

(58) Field of Classification Search
CPC ..... F41B 5/12; F41B 5/123; F41B 5/1469; F41B 5/0094; F41B 5/1411
USPC ..... 124/25
See application file for complete search history.

(56) References Cited

U.S. PATENT DOCUMENTS 3,108,583 A * 10/1963 Andis ..... F41B 5/12 124/22
3,509,863 A * 5/1970 Barker ..... F41B 7/003 124/16
4,169,456 A * 10/1979 Van House ..... F41B 5/12 124/25
4,466,417 A 8/1984 Mulot et al.
4,711,228 A * 12/1987 Gillespie ..... F41B 5/123 124/24.1
4,766,874 A * 8/1988 Nishioka ..... F41B 5/12 124/25
5,243,955 A * 9/1993 Farless ..... F41B 3/005 124/20.1
5,355,866 A * 10/1994 Hunter ..... F41B 7/003 124/16
5,630,405 A * 5/1997 Nizov ..... F41B 5/123 124/25

(Continued)

OTHER PUBLICATIONS

International Search Report and Written Opinion issued in PCT/US2020/031330, dated Aug. 12, 2020, 7 pgs.

*Primary Examiner* — Alexander R Niconovich
(74) *Attorney, Agent, or Firm* — Woodard, Emhardt, Henry, Reeves & Wagner, LLP

(57) ABSTRACT

A crossbow assembly uses an arrangement with two pairs of limbs, with one pair of opposing limbs on each side of the stock. The two limbs within each pair are arranged in opposition to each other in a vertical plane. The limb tips are each connected to an axle assembly with respective limb cables. The axle has a pair of axle pulleys at opposing ends. A bowstring has opposing ends connected to each axle pulley. The bowstring extends forward from each axle pulley and extends across the stock, passing between two bowstring pulleys. The middle of the bowstring forms the nock point.

20 Claims, 6 Drawing Sheets

(56) References Cited

U.S. PATENT DOCUMENTS 5,720,268 A * 2/1998 Koltze ..... F41B 5/0094 124/23.1
6,273,078 B1 * 8/2001 Schwesinger ..... F41B 5/12 124/16
6,895,950 B2 * 5/2005 Gillet ..... A01K 81/04 124/20.3
7,328,693 B2 * 2/2008 Kempf ..... F41B 5/123 124/25
7,891,348 B2 * 2/2011 Colley ..... F41B 5/123 124/25
7,926,474 B2 * 4/2011 Berry ..... F41B 7/04 124/20.3
7,938,108 B2 * 5/2011 Popov ..... F41B 5/123 124/25
8,312,869 B2 * 11/2012 Gillet ..... A01K 81/04 124/20.3
8,485,170 B1 * 7/2013 Prior ..... F41B 5/126 124/27
8,522,762 B2 * 9/2013 Trpkovski ..... F41B 5/1453 124/25.6
8,567,376 B2 * 10/2013 Flint ..... F41B 5/12 124/20.3
8,607,773 B1 * 12/2013 Schultz ..... F41B 7/00 124/25
8,622,050 B2 * 1/2014 Goff ..... F41B 5/12 124/25
8,863,732 B1 * 10/2014 Prior ..... F41B 5/123 124/25
9,052,154 B1 6/2015 Prior
9,097,499 B2 * 8/2015 Goehring, III ..... F41B 5/123
9,255,753 B2 * 2/2016 Pulkrabek ..... F41B 5/105
9,255,756 B1 * 2/2016 Wu ..... F41B 5/123
9,255,764 B2 * 2/2016 Park ..... F41B 7/003
9,297,604 B1 * 3/2016 Sidebottom ..... F41B 5/12
9,719,749 B1 * 8/2017 Prior ..... F41B 5/0094
9,746,276 B2 * 8/2017 Hughes ..... F41B 5/123
9,921,026 B1 * 3/2018 Anderson ..... F41B 5/1469
10,077,963 B1 * 9/2018 Popov ..... F41B 5/12
10,393,470 B1 * 8/2019 Popov ..... F41B 5/105
10,533,822 B1 * 1/2020 Popov ..... F41B 5/123
10,767,956 B2 * 9/2020 Popov ..... F41B 5/123
10,969,192 B1 * 4/2021 Gallops, Jr. ..... F41B 5/105
11,098,973 B2 * 8/2021 Walthert ..... F41B 5/105
2005/0279338 A1 12/2005 Dziekan
2009/0223500 A1 9/2009 Stanziale
2012/0304974 A1 * 12/2012 Goff ..... F41B 5/123 124/25
2015/0233664 A1 8/2015 McPherson
2015/0285581 A1 10/2015 Chang
2016/0273870 A1 9/2016 Pulkrabek et al.
2017/0138691 A1 5/2017 McPherson
2017/0268846 A1 9/2017 Dziekan
2018/0202748 A1 7/2018 Shaffer et al.
2019/0178603 A1 * 6/2019 Laurence ..... F41B 5/123
2020/0370856 A1 * 11/2020 Trpkovski ..... F41B 3/02
2021/0048268 A1 * 2/2021 Trpkovski ..... F41B 3/02

* cited by examiner

CROSSBOW ASSEMBLY

The present application is a continuation of U.S. patent application Ser. No. 15/929,346 filed Apr. 28, 2020, which claims the benefit of U.S. provisional application No. 62/844,182 filed on May 7, 2019, both of which are incorporated herein by reference.

FIELD OF THE INVENTION

The present disclosure relates generally to crossbows.

BACKGROUND OF THE INVENTION

Crossbows have been used for centuries for both hunting and recreation. They are typically characterized by horizontal limbs mounted on a stock with a bowstring that is drawn to store energy. The bowstring is drawn over the rail and held in a latch that holds the bowstring until the user is ready to fire. When the user is ready to shoot an arrow (alternately referred to as a bolt or quarrel), the user pulls a trigger. Upon pulling the trigger, a series of interactions occurs between components of a trigger assembly, allowing the bowstring to be released from the latch and allowing transfer of stored energy to the arrow.

There are several different designs of crossbows. A traditional crossbow has flexible limbs that extend laterally in a horizontal plane. The butt portions or anchor ends of the limbs are mounted adjacent the forward end of a stock or rail. A bowstring extends between the outer limb tips. When the bowstring is drawn, the limbs deflect rearward and inward and store potential energy that is transferred to the bowstring and an arrow when the crossbow is fired. A traditional crossbow can be a recurve style where the bowstring is connected directly to the limb tips or a compound crossbow which has a set of wheels or cams attached to its limbs. In a compound crossbow, a cabling system attached to the wheels or cams is used to assist in bending the limbs as the bowstring is drawn.

A variation is a reverse style crossbow. A typical reverse crossbow has flexible limbs that extend laterally in a horizontal plane, yet the butt portions or anchor ends of the limbs are mounted closer to the user. The limbs curve outward and forward away from the user. When cocked, the limb tips are drawn generally forward and inward toward a central portion. When released, the limb tips spring laterally outward, causing the bowstring to travel forward and propel a projectile such as an arrow. Examples of reverse crossbows are shown in U.S. Pat. No. 3,108,583 to Andis; U.S. Pat. No. 5,630,405 to Nizov; U.S. Pat. No. 4,169,456 to Van House; U.S. Pat. No. 4,766,874 to Nishioka; U.S. Pat. No. 4,879,987 to Nishioka; U.S. Pat. No. 7,328,693 to Kempf, and U.S. Pat. No. 7,938,108 to Popov.

SUMMARY

Certain embodiments of the present crossbow assembly use an arrangement with two pairs of limbs, with one pair of opposing limbs on each side of the stock. The two limbs within each pair are parallel yet arranged in opposition to each other in a vertical plane. The rearward ends of the limbs are anchored with the limb tips being free to move. The limb tips are each connected to an axle assembly with respective limb cables. As the axle assembly is turned it wraps the limb cables around the axle shaft, drawing the limb tips vertically together to store energy, which, when released, causes the axle assembly to rotate to unwind the cables.

At opposing ends of the axle assembly a pair of axle pulleys are arranged in vertical planes. The crossbow includes a bowstring with opposing ends having one end connected to each axle pulley. An intermediate portion of the bowstring extends forward from each axle pulley and extends across the stock, passing between two bowstring pulleys which are arranged in a horizontal plane. The middle of the bowstring forms the nock point, which can be drawn rearward over the rail between the two bowstring pulleys to a latch assembly.

In the brace or undrawn position, the end portions of the bowstring are each wrapped around a respective axle pulley. As the nock point of the bowstring is drawn rearward, the bowstring is unwrapped to feed out from the axle pulleys, causing the axle pulleys to turn and correspondingly rotate the axle shaft. Rotation of the axle shaft winds the limb cables inward to draw the limb tips towards the axle shaft. Upon releasing or firing the crossbow, the nock point of the bowstring is released, allowing the intermediate bowstring portion to translate forward to launch the arrow. Via a linkage of components, the release allows the stored energy in the limbs to be released, allowing the limbs to spring vertically upward and downward and in turn causing the limb cables to unwind from the axle shaft. This causes the axle pulleys to wind the bowstring ends into the respective axle pulleys. The stored limb energy is thus transferred to the nock point of the bowstring and converted to kinetic energy to propel the arrow.

In one illustrative embodiment a crossbow assembly includes a stock with a rail defining a forward direction and defining a bolt guide to guide an arrow. A trigger and latch assembly are housed in the stock and the rail wherein the latch mechanism is configured to selectively retain the nock point of a bowstring until it is released by operation of the trigger. A first limb cup and a second limb cup extend from the stock and arranged on opposing lateral sides of the rail. A first pair of limbs has butt ends mounted to the first limb cup and a second pair of limbs has butt ends mounted to the second limb cup. The first pair of limbs are vertically aligned and arranged to flex with opposing directional forces and the second pair of limbs are vertically aligned and arranged to flex with opposing directional forces. An axle assembly is rotationally mounted adjacent to and underneath a forward end of the rail, the axle assembly including a shaft and a pair of axle pulleys arranged at opposing ends of the shaft. the limb tip of each limb is connected to the axle assembly via a series of limb cables. A pair of bowstring pulleys is arranged adjacent a forward end of the rail on opposing lateral sides of the rail. The bowstring has a nocking point centrally arranged between the bowstring pulleys and arranged to be drawn over the rail to the latch assembly. The bowstring extends from the nocking point to the bowstring pulleys and then along the opposing lateral sides of the rail. The bowstring has two ends with one end engaging each axle pulley.

In an alternate illustrative embodiment, a crossbow assembly has a stock with a rail defining a bolt guide to guide an arrow. A trigger and latch assembly is housed in the stock and the rail. The latch mechanism is configured to selectively retain the nock point of a bowstring until it is released by operation of the trigger. A first limb cup and a second limb cup extend from the stock and are arranged on opposing lateral sides of the rail. A first pair of limbs has butt ends mounted to the first limb cup and a second pair of limbs has butt ends mounted to the second limb cup. The first pair of limbs are vertically aligned and arranged to flex with opposing directional forces and the second pair of limbs are vertically aligned and arranged to flex with opposing directional forces. The bowstring is configured to be drawn over the rail to the latch assembly. The bowstring is operationally linked to the first pair of limbs and the second pair of limbs such that when the bowstring is drawn, the limb tips of the first pair of limbs move towards each other and the limb tips of the second pair of limbs move towards each other. When the bowstring is released, the limb tips of the first pair of limbs move away from each other and the limb tips of the second pair of limbs move away from each other.

In a further illustrative embodiment, a crossbow assembly includes a stock with a rail defining a bolt guide. A trigger and latch assembly is housed in the stock and the rail. The latch mechanism is configured to selectively retain a bowstring drawn over the rail until the bowstring is released by operation of the trigger. A first limb cup and a second limb cup are arranged on opposing lateral sides of the rail. A first pair of limbs has butt ends mounted to the first limb cup and a second pair of limbs has butt ends mounted to the second limb cup. The first pair of limbs are vertically aligned and arranged to flex with opposing directional forces and the second pair of limbs are vertically aligned and arranged to flex with opposing directional forces. An axle assembly is rotationally mounted to the stock. A limb tip of each limb is connected to the axle assembly via a series of limb cables. The bowstring has two ends with each end engaging the axle assembly.

Additional objects and advantages of the described embodiments are apparent from the discussions and drawings herein.

DESCRIPTION OF THE ILLUSTRATED EMBODIMENTS

Figure 1:
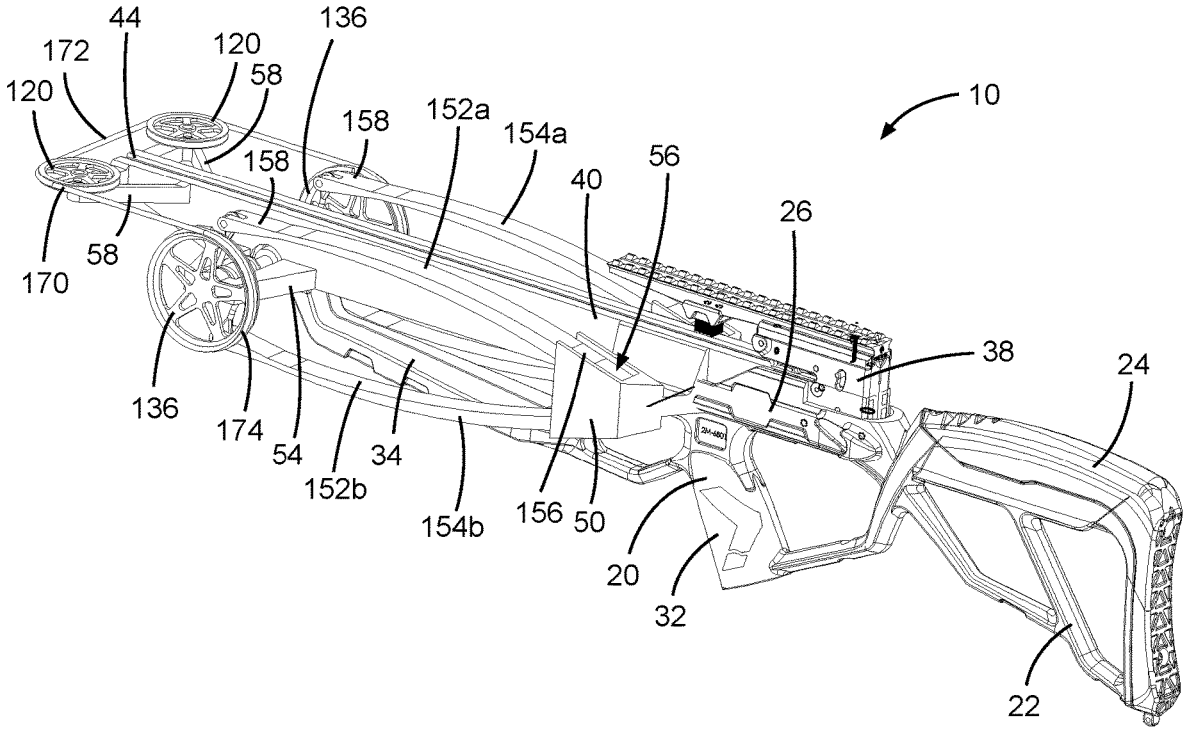
FIG. 1 is a perspective view of a crossbow assembly in an undrawn position illustrating an embodiment of the present disclosure.
Figure 2:
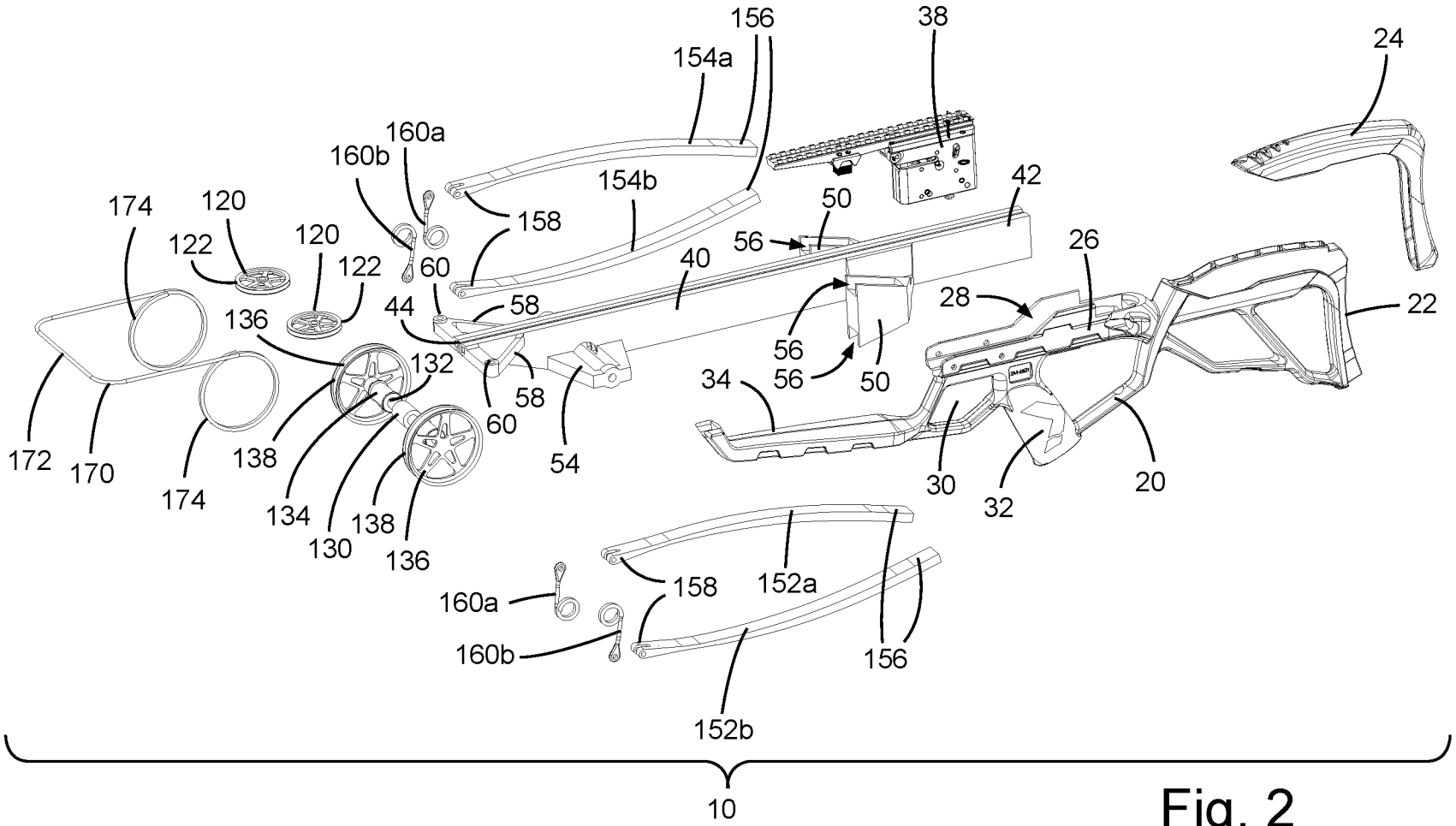
FIG. 2 is an exploded view of the crossbow assembly of FIG. 1.
Figure 3:
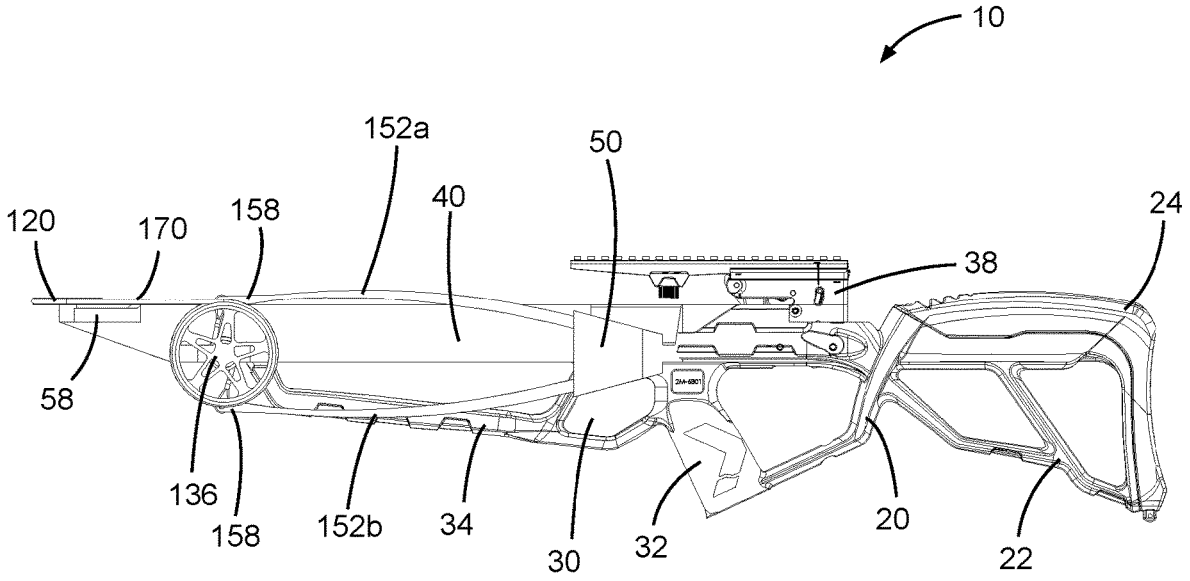
FIG. 3 is a side view of the crossbow assembly of FIG. 1. The opposite side is symmetric.
Figure 4:
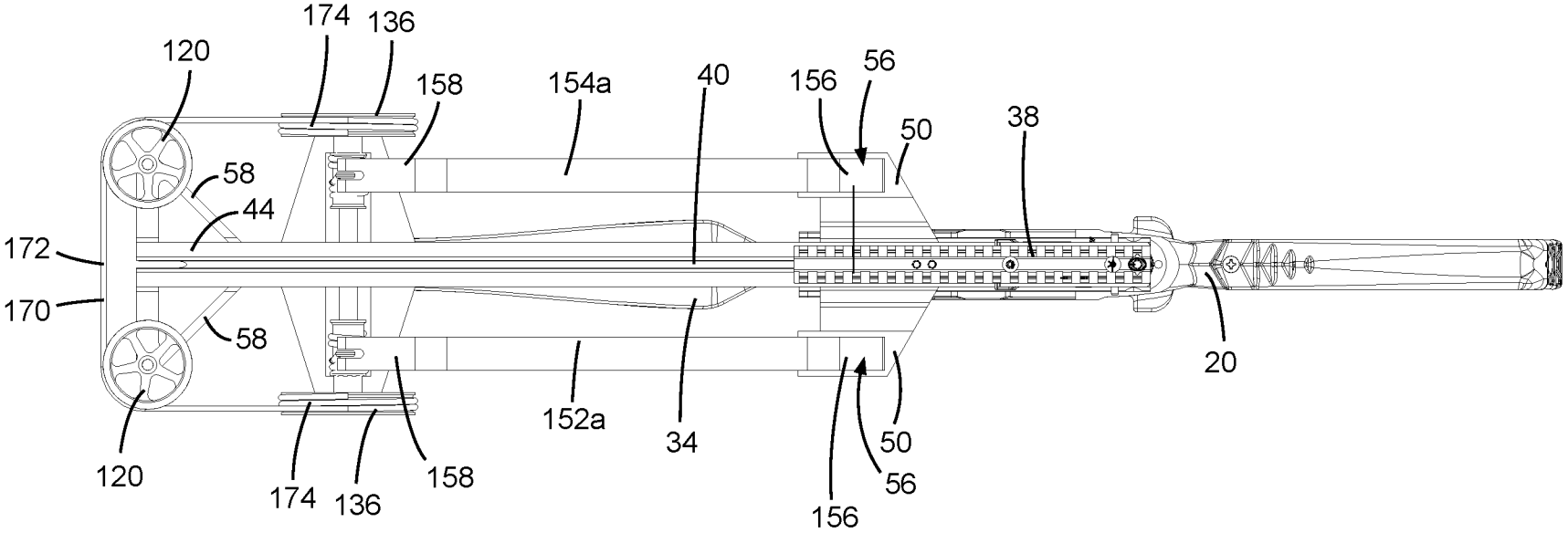
FIG. 4 is a top view of the crossbow assembly of FIG. 1.
Figure 5:
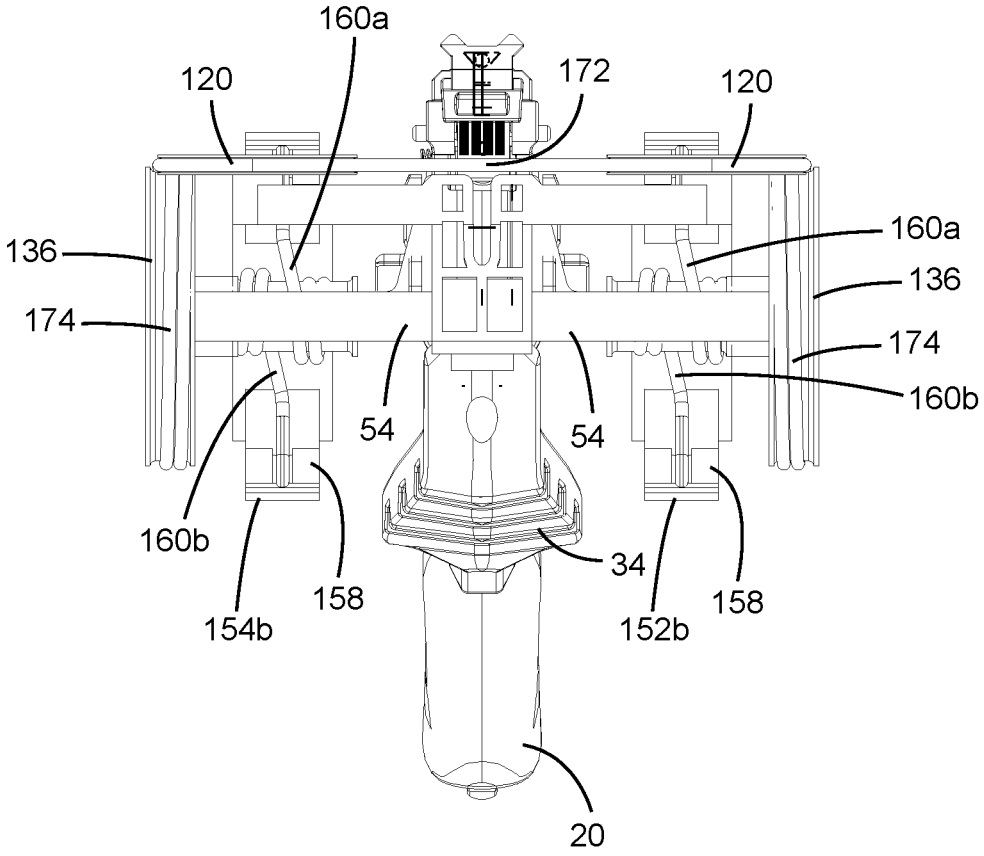
FIG. 5 is a front view of the crossbow assembly of FIG. 1.

For the purposes of promoting an understanding of the principles of the disclosure, reference will now be made to the embodiments illustrated and specific language will be used to describe the same. It will nevertheless be understood that no limitation of the scope of the disclosure is thereby intended, such alterations, modifications, and further applications of the principles being contemplated as would normally occur to one skilled in the art to which the invention relates.

Certain embodiments of the present crossbow assembly use an arrangement with two pairs of limbs, with one pair of opposing limbs on each side of the stock. The two limbs within each pair are parallel yet arranged to flex in opposition to each other in a vertical plane. The rearward ends of the limbs are anchored while the limb tips of the limbs are free to move. The limb tips are each connected to an axle assembly with respective limb cables. As the axle assembly is turned it wraps the limb cables around the axle shaft, drawing the limb tips vertically together to store energy, which, when released, causes the axle assembly to rotate to unwind the cables.

At opposing ends of the axle assembly a pair of axle pulleys are arranged in vertical planes. The crossbow includes a bowstring with opposing ends having one end connected to each axle pulley. An intermediate portion of the bowstring extends forward from each axle pulley and extends across the stock, passing between two bowstring pulleys which are arranged in a horizontal plane. The middle of the bowstring forms the nock point, which can be drawn rearward between the two bowstring pulleys and over the rail to a latch assembly.

In the brace or undrawn position, the end portions of the bowstring are each wrapped around a respective axle pulley. As the nock point of the bowstring is pulled rearward, the bowstring is unwrapped to feed out from the axle pulleys, causing the axle pulleys to turn and correspondingly rotate the axle shaft. Rotation of the axle shaft winds the limb cables around the shaft to draw the limb tips towards the axle shaft. Upon releasing or firing the crossbow, the nock point of the bowstring is released, allowing the intermediate bowstring portion to translate forward to launch the arrow. Via the linkage of components, the release of the bowstring allows the stored energy in the limbs to be released, causing the limbs to spring vertically upward and downward causing the limb cables to unwind from the axle shaft. This causes the axle pulleys to wind the bowstring ends into the respective axle pulleys. The stored limb energy is thus transferred to the nock point of the bowstring and converted to kinetic energy to propel the arrow.

FIGS. 1-5 illustrate a crossbow assembly 10 shown in perspective, exploded, side, top and front views. The crossbow assembly 10 includes a stock 20 with a rail 40. A trigger and latch assembly 38 is housed in the stock and rail and extends between the stock and rail.

The stock 20 generally defines a forward end and a butt end 22. For the purposes of this disclosure, the forward direction of the crossbow assembly 10 is defined as being in the direction of shooting. The rearward direction is defined as being toward the butt end 22 of the crossbow. Directional references herein are for ease of illustration and are not intended to be limiting.

Stock 20 can be assembled as one or more pieces. The butt end 22 is at the rearward end of stock 20 and forms the rearward end of the crossbow assembly 10. Optionally a butt pad 24 can be mounted on butt end 22 to be arranged against the user's shoulder during use. The stock 20 extends forward to central section 26. Central section 26 typically provides the user with a place to hold the crossbow assembly 10, such as grip 32. In the embodiment shown, stock 20 also includes a forwardly placed handle 34. A trigger guard section 30 is arranged in central section 26 between the grip 32 and handle 34.

In alternate embodiments, forwardly placed handle 34 may be a separate piece spaced and mounted forward of the trigger guard, or handle 34 may be omitted. Optionally as a separate piece, the position of the handle may be selectively adjusted forward or rearward for the user's comfort, for example by sliding the handle along the bottom of an accessory rail extending along the lower surface of rail 40 and then locking it in a desired location with a clamp or screws. Optionally, the handle may be asymmetric and reversibly mountable, for example with one end having a more horizontal aspect and the other end having a more vertical aspect, which can be arranged to match a user's desired orientation.

In the embodiment shown, rail 40 is attached on top of stock 20 and is partially received within a channel or cavity 28 in central section 26. The upper surface and longitudinal axis of rail 40 defines a bolt guide, for example a pair of rails on opposites sides of a groove, upon which the shaft of an arrow or crossbow bolt can rest and which guides the arrow when it is released. Rail 40 includes a rearward end 42 partially received within cavity 28 in stock 20, for example adjacent the rearward portion of trigger guard section 30 and grip 32. The forward end 44 of rail 40 may extend past the forward end of stock 20. In other embodiments, stock 20 may extend along the length of the entire rail 40, or stock 20 and rail 40 may be formed as a single piece. In certain embodiments, rail 40 has a hollow interior. Rail 40 can be made of metal, for example using aluminum. The rail can be extruded, with desired fastener holes, slots and other openings cut or machined after the extrusion process.

Optionally, a rail cap can be used to close the forward end 44 of rail 40. Further optionally, rail 40 may include an accessory mounting rail, sometimes called a picatinny rail, for example on the lower side of rail 40 adjacent to forward end 44. Finger guards may optionally be mounted on opposing sides of rail 40, for example adjacent and parallel to handle 34.

The trigger and latch assembly 38 is partially housed within the cavity 28 and extends above and below rail 40. A pivotal trigger extends downward through a trigger slot defined in the rail 40 and stock 20, within the space defined by the trigger guard section 30. A trigger linkage operatively extends within stock 20 and rail 40 between the trigger and latch assembly 38. Latch assembly 38 includes a latch mechanism which can receive and selectively retain the nock point 172 of bowstring 170 and the rear portion or nock of a crossbow arrow on top of rail 40. Latch assembly 38 holds the bowstring 170 and arrow until it is released when a user operates or pulls the trigger.

When the bowstring 170 is drawn rearward over rail 40, the nock point 172 is pulled into latch assembly 38, where it is held until the trigger is operated to fire the arrow. The arrow then travels forward along the axis of the bolt guide of rail 40. The latch assembly may include appropriate internal operating mechanisms as well as safety mechanisms to prevent unintended release and an anti-dryfire mechanism. A variety of trigger and latch mechanisms are available and any suitable mechanism for firing an arrow from crossbow assembly 10 may be chosen.

A pair of first and second limb cups 50 is arranged on opposing lateral sides of rail 40. Limb cups 50 may be integrally formed with stock 20 and rail 40 or may be made separately and attached. In the illustrated embodiment, limb cups 50 are arranged toward the rear of rail 40, for example close to latch assembly 38 and/or trigger guard section 30. The limb cups 50 are laterally offset from rail 40 with a pair of support extensions. Each limb cup 50 includes a pair of cavities defining a pair of limb pockets 56. In the illustrated embodiments, each limb cup 50 includes an upward facing limb pocket 56 and a downward facing limb pocket 56. The limb pockets 56 in each limb cup 50 are vertically aligned and symmetrically arranged in opposition to each other.

A first pair of opposing limbs and a second pair of opposing limbs are on each lateral side of stock 20 and rail 40. In the illustrated embodiments, all of the limbs are parallel to rail 40. For instance, FIGS. 1-5 illustrate a first pair of limbs 152*a*, 152*b* on one side of rail 40 and a second pair of limbs 154*a*, 154*b* on the opposite side of rail 40. The first pair of limbs includes an upper limb 152*a* and a lower limb 152*b*. Correspondingly, the second pair of limbs includes an upper limb 154*a* and a lower limb 154*b*. The limbs within each pair are vertically aligned and balanced, yet arranged to flex with opposing directional forces. For instance, during the draw cycle the limb tips move towards each other at the same rate, while when released the limb tips move away from each other at the same rate. Among other aspects, the limbs flexing in opposite vertical directions serves to minimize vertical rebound forces when crossbow assembly 10 is fired.

Within each pair, the limbs are vertically aligned or stacked and symmetrically arranged in opposition to each other. As illustrated, upper limb 152*a* extends forward from a butt end 156 with a downwardly concave shaped curve to limb tip 158. As a mirror image, lower limb 152*b* extends forward from a butt end 156 with an upwardly concave shaped curve to limb tip 158. The butt end 156 of upper limb 152*a* is received and retained in an upward facing limb pocket 56. The butt end 156 of lower limb 152*b* is received and retained in a downward facing limb pocket 56. The second pair of limbs 154*a*, 154*b* are arranged in a similar manner on the opposite side of rail 40.

Figure 6:
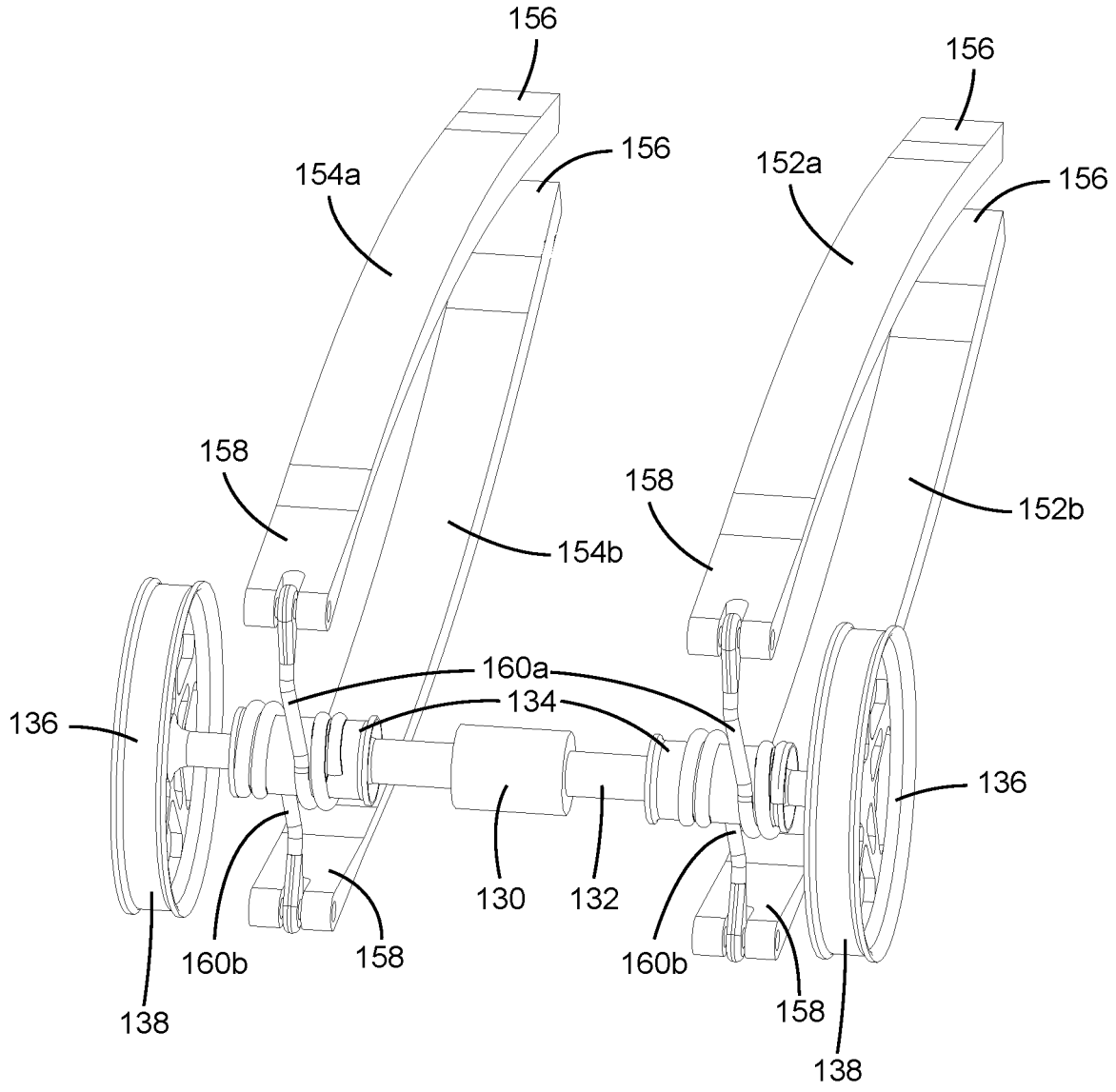
FIG. 6 is a partial view of the crossbow assembly of FIG. 1 illustrating the interaction of the limbs, the axle assembly and the limb cables. Other portions of the crossbow assembly are not shown in FIG. 6 for ease of illustration.

Axle assembly 130 (best seen in FIG. 6) is rotationally mounted adjacent to and underneath the forward end of rail 40. Axle assembly 130 may be formed as one integral piece or may be an assembly of connected pieces. Axle assembly 130 includes a horizontal axle shaft 132. A pair of optional drum or spool portions 134 with a larger diameter than shaft 132 may be fixedly mounted along the length of shaft 132. A pair of axle pulleys or cams 136 are fixedly arranged at opposing ends of shaft 132. Axle pulleys 136 define peripheral grooves 138. The planes in which axle pulleys 136 rotate are a pair of parallel vertical planes. The vertical planes are perpendicular to the rotational axis of shaft 132. In some embodiments, axle assembly 130 is rotationally mounted to rail 40 via a pair of mounting flanges or bosses 54 which may include bushings. Bosses 54 extend laterally to either side of rail 40. Bosses 54 may be integrally made with rail 40 or may be made separately and mounted to rail 40. Shaft 132 is supported adjacent its opposing ends by bosses 54.

A pair of supports 58 are arranged adjacent the forward end 44 of rail 40. In certain embodiments, each support 58 is formed by two struts which extend from rail 40 to form a triangle. Supports 58 may be integrally made with rail 40 or may be made separately and mounted to rail 40. Supports 58 are typically arranged level with or below the level of the upper surface of rail 40. A pair of mounting locations 60 is defined at offset outer points of supports 58. For example, the mounting locations 60 may be located at the outer corners when supports 58 are triangles. A pair of bowstring pulleys or cams 120 are symmetrically mounted relative to rail 40 and rotationally mounted at the mounting locations 60. The planes in which the bowstring pulleys 120 rotate are horizontal and co-planar. Bowstring pulleys 120 define peripheral grooves 122, which are aligned with the height of an arrow shaft on rail 40. The plane of bowstring pulleys 120 is perpendicular to the vertical planes of axle pulleys 136.

A cable system including a bowstring and a series of limb cables operationally links the limbs, the axle shaft, the axle pulleys, the bowstring pulleys and the latch assembly. As illustrated in detail in FIG. 6, the limb tip 158 of each limb is connected to axle assembly 130 via a series of limb cables. For instance, the limb tips 158 of upper limbs 152*a* and 154*a* are each secured to an end of a respective first and second upper limb cable 160*a*. The opposing end of each upper limb cable 160*a* is mounted to shaft 132, with a medial portion of the upper limb cable 160*a* wrapped around shaft 132. Optionally, the shaft end and medial portion of each upper limb cable 160*a* may be wrapped around a respective drum portion 134. The diameter of drum portions 134 can be selectively chosen and/or modified to control the ratio of the length that each limb cable is wrapped or unwrapped to the rotational degree of change in the axle shaft.

In a mirror image, the limb tips 158 of lower limbs 152*b* and 154*b* are each secured to an end of a respective first and second lower limb cable 160*b*. The opposing end of each lower limb cable 160*b* is mounted to shaft 132, with a medial portion of the lower limb cable 160*b* wrapped around shaft 132. Optionally, the shaft end and medial portion of each lower limb cable may be wrapped around a respective drum portion 134. Upper limb cables 160*a* and lower limb cables 160*b* are symmetrically arranged in direction around shaft 132 so that they all wrap around shaft 132 when the axle assembly 130 is rotated in one direction (counter-clockwise from the perspective of FIG. 3), and all unwrap from shaft 132 when axle assembly 130 is rotated in the opposite direction (clockwise from the perspective of FIG. 3).

Bowstring 170 has a nocking point 172 centrally arranged between bowstring pulleys 120 and aligned in height with the nock of an arrow on rail 40. Bowstring 170 extends laterally in two directions from nocking point 172, with respective lateral portions received in grooves 122 of bowstring pulleys 120. Bowstring pulleys 120 each turn bowstring 170 in substantially a 90 degree turn. From bowstring pulleys 120, bowstring 170 extends rearward on both sides of rail 40, with the opposing bowstring ends each engaging and secured to a respective axle pulley 136. A portion of bowstring 170 adjacent to each opposing end forms a wrapped portion 174 received in a respective axle pulley groove 138 and extending at least partially around the circumference of each axle pulley 136. The specific length of wrapped portion 174 varies depending on whether crossbow assembly 10 is in a drawn or released position. In the illustrated embodiments, the upper portions of axle pulley grooves 138 are aligned in a horizontal plane with bowstring pulley grooves 122. This orients the bowstring 170 so that the portions between bowstring pulleys 120 and axle pulleys 136 extend and travel in lines parallel to the longitudinal axis of rail 40.

Wrapped portions 174 are arranged in direction around axle pulleys 136 so that when nocking point 172 is drawn rearward, bowstring 170 translates forward and inward around bowstring pulleys 120, causing portions 174 to unwrap from the respective axle pulleys 136. Simultaneously upper limb cables 160*a* and lower limb cables 160*b* wrap around shaft 132 consequently drawing limb tips 158 towards axle shaft 132. Conversely, when nocking point 172 travels forward, bowstring 170 translates outward and rearward around bowstring pulleys 120, allowing more length to be wrapped around respective axle pulleys 136. Simultaneously upper limb cables 160*a* and lower limb cables 160*b* unwrap from shaft 132 allowing limb tips 158 to travel away from axle shaft 132.

During the draw cycle of crossbow assembly 10, nocking point 172 is drawn rearward between forward pulleys 120 and secured by latch assembly 38. The crossbow components are operationally linked so that during the draw cycle, force applied to draw nocking point 172 rearward causes motion in the bowstring, the bowstring pulleys, the axle assembly and the limb cables to flex the limbs to store energy in the limbs. Once bowstring 170 is fully drawn and latched, an arrow is inserted onto the bolt guide on rail 40, and the rear end or nock of the arrow is positioned on bowstring 170 at nocking point 172. Once the arrow is positioned, the crossbow assembly 10 is ready to be fired upon release of any safeties and proper operation of the trigger. When a user pulls the trigger to fire the crossbow, latch assembly 38 releases nocking point 172. Via the operationally linked assembly components, the stored energy in the limbs applies force via limb cables 160*a* and 160*b* to rotate the axle assembly, which in turn rotates axle pulleys 136 to pull and wrap portions of bowstring 170 to translate outward and rearward around bowstring pulleys 120, thus transmitting force to an arrow at nocking point 172.

In alternate embodiments, a variation of crossbow assembly 10 could be made with only one pair of limbs, with one limb on either lateral side of stock 20 and rail 40. For instance, such embodiments could use only upper limbs 152*a*, 154*a* or only lower limbs 152*b*, 154*b*. This would apply asymmetric loads to the end of axle assembly 130, and may require a stronger axle assembly to prevent the axle from bending. An arrangement with only an upper pair of limbs or only a lower pair of limbs would correspondingly clear the area under the rail or above the rail. An illustration of an embodiment with only upper limbs 152*a*, 154*a* would correspond to FIG. 6 with lower limbs 154*b*, 152*b*, and cables 160*b* removed. Conversely, an illustration of an embodiment with only lower limbs 152*b*, 154*b* would correspond to FIG. 6 with upper limbs 154*a*, 152*a*, and cables 160*a* removed. Corresponding modifications would be made to the embodiment illustrated in FIGS. 1-5.

Crossbow assembly 10 as illustrated in FIGS. 1-5 is a reverse crossbow, in the sense that the limb butts are mounted at rearward locations and the limb lengths extend forward. In alternate embodiments, the limb butts could be mounted at forward locations, with the limb lengths extending rearward. A corresponding modification to the location of axle assembly 130 would be needed. In further alternate embodiments the limb orientation could be modified, for instance with two pairs of limbs arranged on opposing vertical sides of the stock and each pair of opposing limbs arranged in a horizontal plane.

Embodiments of crossbow assembly 10 may have accessories attached to the stock or rail. For example, some embodiments may include any or all of the following: a scope, a dry-fire prevention mechanism, a safety, a cocking mechanism, one or more stabilizers, a pole, bipod or tripod mount, one or more vibration dampeners, a quiver, a stirrup, a bowstring drawing cocking aid, a flashlight, a laser pointer and/or a camera.

Components of crossbow assembly 10 may be made from any material that allows for effective operation of the crossbow. The material for different pieces of the crossbow assembly 10 may vary within the same embodiment. For example, in some embodiments, pieces of the crossbow assembly 10 may be made using metal, such as aluminum or steel, composites like carbon fiber or any of a variety of plastics or polymers and/or from wood. As would be understood by those of skill in the art, various fasteners or fastening methods may be used to assemble the components of crossbow assembly 10, but have not been illustrated or discussed in detail.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A crossbow assembly comprising:

a. a stock with a rail defining a forward direction along a longitudinal axis, the rail defining a bolt guide to guide an arrow along the longitudinal axis;

b. an axle assembly rotationally mounted below a forward end of the rail, the axle assembly including a shaft with a rotational axis perpendicular to the longitudinal axis of the rail;

c. first and second axle pulleys arranged in vertical planes at opposing ends of the shaft;

d. a bowstring with a first end connected to first axle pulley and a second end connected to the second axle pulley, a middle of the bowstring defining a nock point arranged to be drawn rearward over the rail, wherein drawing the nock point rearward corresponds with rotation of the axle assembly in a first direction and wherein forward translation of the nock point during firing corresponds with rotation of a drawstring in a second direction;

e. at least a first limb mounted on a first side of the stock and arranged to flex in a vertical plane and wherein a limb tip of the first limb is connected to the axle assembly via a first limb cable;

f. at least a second limb mounted on a second side of the stock and arranged to flex in a vertical plane and wherein a limb tip of the second limb is connected to the axle assembly via a second limb cable; and g. wherein drawing the nock point rearward corresponds with drawing the limb tip of the first limb toward the axle assembly and drawing the limb tip of the second limb toward the axle assembly and wherein when a release of the nock point occurs during firing the first limb and the second limb apply force to rotate the axle assembly to propel the nock point forward.

2. The crossbow assembly of claim 1, wherein the at least a first limb and the at least a second limb are parallel to the rail.

3. The crossbow assembly of claim 1, comprising a pair of bowstring pulleys arranged on opposing lateral sides of the rail wherein the bowstring extends from the axle pulleys and is received in grooves of the bowstring pulleys and wherein the bowstring nocking point is centrally arranged between the bowstring pulleys.

4. The crossbow assembly of claim 3, wherein the pair of bowstring pulleys are arranged in a plane perpendicular to the vertical planes of the axle pulleys.

5. The crossbow assembly of claim 1, wherein a medial portion of the first upper limb cable is wrapped around the axle assembly and a medial portion of the second upper limb cable is wrapped around the axle assembly.

6. The crossbow assembly of claim 5, wherein the axle assembly comprises drum portions having a larger diameter than the shaft, wherein the medial portions of the first limb cable and the second limb cables are wrapped around the drum portions.

7. The crossbow assembly of claim 1, wherein the at least a first limb extends forward from a butt end mounted to the stock and the at least a second limb extends forward from a butt end mounted to the stock.

8. The crossbow assembly of claim 1, comprising a first limb cup and a second limb cup extending from the stock and arranged on opposing lateral sides of the rail; and wherein a butt end of the at least a first limb is mounted to the first limb cup and wherein a butt end of the at least a second limb is mounted to the second limb cup.

9. The crossbow assembly of claim 1, wherein a portion of the bowstring adjacent to each end forms a wrapped portion extending at least partially around a circumference of one of the axle pulleys.

10. The crossbow assembly of claim 1, comprising a trigger and latch assembly housed in the stock and the rail wherein the latch assembly is configured to selectively retain the nock point of the bowstring until it is released by operation of the trigger.

11. A crossbow assembly comprising:

a. a stock with a rail defining a bolt guide to guide an arrow;

b. a trigger and latch assembly housed in the stock and the rail wherein the latch assembly is configured to selectively retain a nock point of a bowstring until it is released by operation of the trigger;

c. an axle assembly rotationally mounted below a forward end of the rail, the axle assembly including a shaft with a rotational axis perpendicular to a longitudinal axis of the rail;

d. at least a pair of limbs with butt ends mounted on opposing lateral sides of the rail wherein the pair of limbs are parallel to the rail, wherein the pair of limbs are arranged to flex in distinct vertical planes; and e. a bowstring with opposing ends secured to the axle assembly, wherein the bowstring is configured to be drawn over the rail to the latch assembly, wherein the bowstring is operationally linked to the pair of limbs such that when the bowstring is drawn rearward, limb tips of the pair of limbs move towards the axle assembly, and wherein when the bowstring is released the limb tips of the pair of limbs move away from the axle assembly.

12. The crossbow assembly of claim 11, wherein each limb extends forward from the butt end to the limb tip.

13. The crossbow assembly of claim 11, comprising a pair of limb cables, each limb cable connecting the limb tip of a limb to the axle assembly, wherein when the bowstring is drawn rearward, the limb cables draw the limb tips towards the axle assembly.

14. The crossbow assembly of claim 11, comprising a pair of bowstring pulleys arranged on opposing lateral sides of the rail wherein with respective lateral portions of the bowstring are received in grooves of the bowstring pulleys and wherein the bowstring nocking point is arranged between the bowstring pulleys.

15. The crossbow assembly of claim 14, wherein the bowstring extends laterally in a first direction from each bowstring pulley and extends rearwardly in a different direction from each bowstring pulley.

16. A crossbow assembly comprising:

a. a stock with a rail defining a bolt guide;

b. a trigger and latch assembly housed in the stock and the rail wherein the latch assembly is configured to selectively retain a bowstring drawn over the rail until the bowstring is released by operation of the trigger;

c. a pair of limbs with butt ends mounted on opposing lateral sides of the rail wherein the pair of limbs are parallel to the rail, wherein the pair of limbs are arranged to flex in a pair of distinct vertical planes;

d. an axle assembly rotationally mounted to the stock, the axle assembly having a rotational axis perpendicular to the rail;

e. wherein a limb tip of each limb is connected to the axle assembly via a limb cable; and f. a bowstring having two ends with each end engaging the axle assembly.

17. The crossbow assembly of claim 16, wherein the axle assembly comprises a pair of axle pulleys arranged in parallel vertical planes.

18. The crossbow assembly of claim 17, wherein a portion of the bowstring adjacent to each end forms a wrapped portion extending at least partially around a circumference of one of the axle pulleys.

19. The crossbow assembly of claim 16, comprising a pair of bowstring pulleys aligned in a horizontal plane on opposing lateral sides of the rail wherein the bowstring extends from the axle pulleys and is received in grooves of the bowstring pulleys and wherein the bowstring nocking point is arranged between the bowstring pulleys.

20. The crossbow assembly of claim 19, wherein the bowstring extends laterally in a first direction from each bowstring pulley and extends rearwardly in a different direction from each bowstring pulley.

* * * * *